United States Patent [19]

Dawbarn et al.

[11] Patent Number: 4,472,220

[45] Date of Patent: Sep. 18, 1984

[54] TEXTILE DETEXTURIZING SYSTEM

[75] Inventors: H. Dunlop Dawbarn, Augusta County, Va.; James P. Pearson, Carter County, Tenn.

[73] Assignee: Camac Corporation, Bristol, Va.

[21] Appl. No.: 320,917

[22] Filed: Nov. 12, 1981

[51] Int. Cl.[3] ..... A46D 1/00; B32B 5/00

[52] U.S. Cl. ..... 156/72; 8/115.5; 8/115.6; 8/130.1; 8/DIG. 21; 28/159; 28/160; 28/247; 28/252; 156/83; 156/148; 156/183; 156/390; 156/435; 242/54.4; 242/178; 264/168; 264/210.8; 264/343; 428/96; 428/906

[58] Field of Search ..... 242/54.4, 178; 29/121.4; 28/159, 247, 160, 252; 8/115.5, 115.6, 130.1, DIG. 21; 428/96, 906; 156/72, 183, 83, 390, 148, 435, 175; 264/168, 343, 210.8

[56] References Cited

U.S. PATENT DOCUMENTS

| | | | |
|---|---|---|---|
| 2,266,846 | 12/1941 | Buff | 28/159 |
| 2,277,574 | 3/1942 | Abbott | 242/178 |
| 3,137,911 | 6/1964 | Bromley | 28/252 |
| 3,153,106 | 10/1964 | Schlick | 28/252 |
| 3,396,445 | 8/1968 | Hopkins et al. | 28/252 |
| 3,488,245 | 1/1970 | Thatcher | 156/435 |
| 3,518,734 | 7/1970 | Hermes | 28/247 |
| 3,596,334 | 8/1971 | Kobayashi et al. | 28/252 |

FOREIGN PATENT DOCUMENTS

| | | | |
|---|---|---|---|
| 1112077 | 5/1968 | United Kingdom | 264/168 |

*Primary Examiner*—John J. Gallagher
*Attorney, Agent, or Firm*—John F. C. Glenn

[57] ABSTRACT

In order to produce random changes in texture of pile fabrics, continuous multifilament bulked yarn is treated to detexturize spaced portions along its length.

10 Claims, 3 Drawing Figures

TEXTILE DETEXTURIZING SYSTEM

BACKGROUND OF THE INVENTION

Pile fabrics are commercially produced in various conventional ways, such as applying tufting to a backing material, or by cutting between a double woven or double knit construction. It both cases continuous multifilament bulked yarn is often used to provide the upstanding pile fibers. The appearance of the final product is a major concern, and one significant factor governing appearance is the texture of the pile fabrics. Hence, it has been conventional to try to maintain uniform texture of the pile, by avoiding variations in the processing of the yarn from the time it is spun until completion of the pile fabric. However uniformly the yarn and fabric may be made, there will still be occasions when abberations of the machinery for incorporating the yarn into the fabric will result in small flaws, such as slubs or streaking, which will be faintly visible on close inspection of the pile but which do not otherwise affect the usefulness of the fabric. For purposes of economy it is desirable to avoid scrapping fabric with such flaws, and hence there has been a long standing need for a method of preventing such flaws from marring the appearance of the fabric to a commercially significant degree.

SUMMARY OF THE INVENTION

In accordance with the present invention, the texture of multifilament bulked yarn is intermittently modified along the length of the yarn, so as to cause random variations in visible texture along the length of pile fibers formed from each length of such yarn incorporated in the final fabric. This produces visible streaks of texture variation distributed generally equally but in a random arrangement across the whole face of the pile, and thus obscures minor flaws such as those resulting from the above-mentioned mechanical abberations in forming the pile fabric. It may also have some ornamental appeal in its own right.

The invention further provides means and methods for producing such variations in the final fabric by intermittent treatment along the length of the yarn, possibly after completion of production of the yarn, but preferably in the course of continuous production of the yarn at normal production speeds. The treatment must be such that its effects will survive or be completed during subsequent operations in making the pile fabric, such as the conventional curing of the latex backing of tufted fabrics.

It would be difficult to provide such intermittent treatment through variations of operation of a jet of air or steam directed against bulked yarn, because it would be hard to do so at sufficiently close intervals, (at least a few hundreths of a second) to achieve reasonably short intervals of change of texture of the yarn (such as about one cycle of change per meter) while running the yarn at the speeds customary in commercial production (at least several hundred meters per minute). Instead, the present preferred practice of the invention achieves such intermittent treatment by operating on a limited portion of the yarn in wound form instead of on the yarn passing in unwound form through the production operation. Such treatment of a limited portion of a wound body of the yarn automatically results in the desired intermittent lengths of the yarn having been subjected to a treating step after it is unwound from the treated body of yarn. While this may be accomplished by treating one end of a wound body of yarn, such as by submerging it in a bath of treating fluid, the present preferred practice of the invention is to apply the treating fluid to a limited portion of the exposed surface of the body of yarn as it is being wound.

As to the treatment itself, the invention contemplates applying a fluid to yarn formed from a polymer which undergoes a change in textural characteristics when exposed to the fluid, to an extent visible in the final pile product. In the case of yarn for tufted fabrics, such visible result must occur in spite of or with the aid of the heat and steam effects of curing of the latex backing of tufted fabrics into which the yarn will go. This has been demonstrated to be true in the case of nylon bulked yarn exposed to water as a result of a wound body of the yarn being partially immersed in water, or as a result of water being applied to part of the side of a body of the yarn while it is being wound. Water temperature is not critical in the case of unheatset nylon, so room temperature water can be used. However, if the nylon were to be heatset, water of about boiling temperature would be required. For example, a conventionally wound body of bulked nylon yarn was held for several minutes in an oven at 250° F. before one end of the body was dipped in water at room temperature. The water-treated part of the yarn preheated at 250° F. was not visibly detexturized, contrary to the result when the 250° F. preheat is omitted. Normal tension for package winding is used, for conventional reasons, and also because absence of tension eliminates the desired detexturing action of the water on the yarn.

Water, at least when at room temperature, does not detexturize polyester, polyethylene or polypropylene bulked yarns. For the latter yarns the detexturizing treatment must rely on some action other than absorption of water, such as heat.

BRIEF DESCRIPTION OF THE DRAWING

The present preferred practice of the invention is schematically illustrated in the accompanying drawing in which.

DETAILED DESCRIPTION OF THE PREFERRED EMBODIMENT

Figure 1:
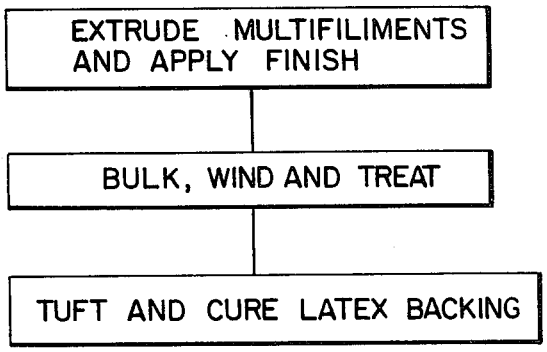
FIG. 1 is a flow sheet for producing and tufting bulk yarn, treated in accordance with the invention.

In the present preferred practice of the invention the following successive steps are performed (illustrated in the flow diagram shown in FIG. 1):

(1) Molten polymer is extruded through a multiport die called a spinerette to form multiple filaments of yarn. The denier and number of filaments vary, depending on end use. Usually the number of filaments is over 100, and the denier is at least several hundred.

(2) The extruded filaments are usually given a conventional finish coating, for lubrication and static control, as they pass onto a winder tube.

(3) The yarn is "bulked", which means that the filaments are individually wrinkled so that as a group they tend to fluff out and thereby increase the apparent bulk of the yarn. Tension reduces such wrinkling, but the yarn rewrinkles itself when tension is relieved. In the present preferred practice of the invention this is done in equipment furnished by Textured Yarn Co., Inc., of Kennett Square, Pa., wherein the yarn is stretched and heated before being forced into a stuffer box.

Figure 2:
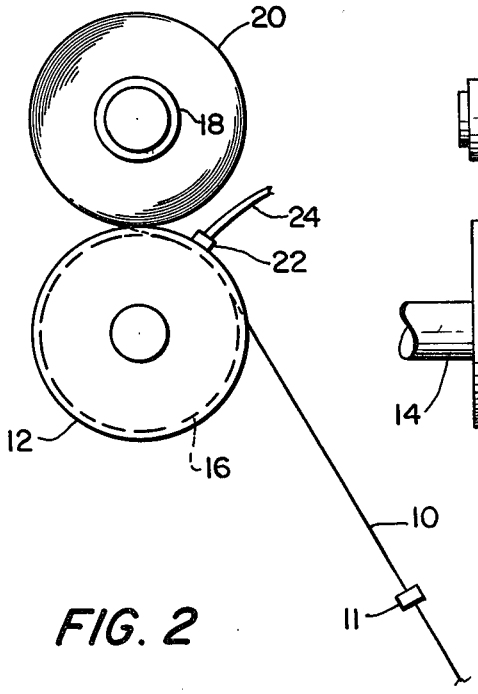
FIG. 2 is an end view of a traversing roll for winding yarn, and a body of yarn being wound on the roll, with a treatment applicator in accordance with the invention.
Figure 3:
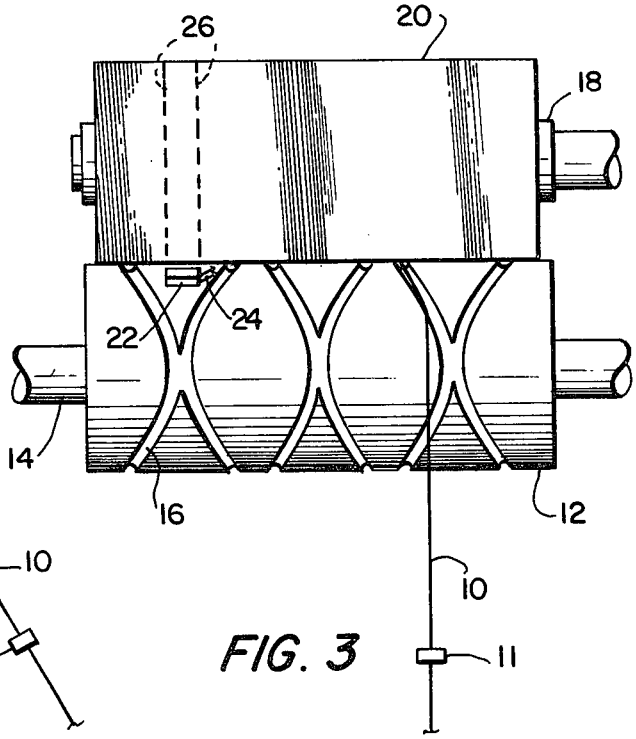
FIG. 3 is a side view of the apparatus shown in FIG. 2.

(4) The resultant bulked yarn is drawn, while under controlled back tension, onto the winder illustrated in FIGS. 2 and 3, where it is treated in accordance with the present preferred practice of the invention as it is wound onto a conventional body of yarn (known as a "package").

(5) The wound yarn produced in step 4 (as originally wound in the yarn plant, or possibly as rewound in a different package to suit the customer's equipment) is shipped to a tufted fabric manufacturer. There hundreds of such yarn packages are mounted in a creel, from which the yarn from each package is separately drawn off through tubes to a tufting machine containing a corresponding number of separate but closely spaced tufting units, each equipped with a tufting needle and cutting blade. The tufting machine mechanically forms each package of yarn into a series of closely spaced tufts extending in a straight line along the supporting fabric in which the tufts are implanted. Each tuft has the cut ends of the yarn projecting upwardly on one side of the supporting fabric to form the pile, and has the intermediate portions of the cut lengths of yarn extending through to the opposite side of the supporting fabric.

(6) The resulting tufted fabric is coated with a latex solution on the side of the fabric opposite to the pile side, and then the latex coating is heat cured. This heat treatment results in evolution of steam to which the pile fibers are necessarily exposed.

The above-described steps are conventional, but in step 4 the present preferred practice and apparatus of the invention is used, as hereinafter described.

As shown in FIGS. 2 and 3, a length of bulked yarn 10, which has been drawn off with minimum tension from the stuffer box of the bulking unit, is passed around conventional means 11 for imparting conventional back tension to the yarn as it is being wound. The yarn passes from the back-tensioning means on to a winding roll 12 having a shaft 14 rotatable by drive means (not shown).

The roll 12 has conventional grooves 16 indented in its face for receiving the incoming yarn 10 and traversing it back and forth across the width of roll 12 as the yarn is wound around a freely rotatable and vertically movable tube 18 to form a wound body of yarn 20. The yarn body 20 rolls upon and is frictionally driven by roll 12. All of the equipment so far described is conventional and is illustrated only schematically.

In accordance with the present preferred practice of the invention, a felt or other porous applicator 22 is mounted in a fixed position adjacent the surface of the roll 12 moving toward rolling contact with the body of yarn 20. A meter pump (not shown) supplies treating liquid through a tube 24 to the applicator 22, where the liquid seeps through the applicator and is transferred to the adjacent outer surface of the revolving roll 12. This surface coating of liquid on roll 12 in turn transfers to the outer surface of the yarn body 20. The axial length of the face of applicator 22 against the yarn body thus determines the width of the liquid coating transferred to the body of wound yarn 20, as indicated by the space between dotted lines 26 in FIG. 3.

As a result of this application of liquid to the yarn body 20, the yarn unwound from it, because it was wound helically back and forth across the length of yarn body 20, will have been treated by the liquid supplied through applicator 22 only in the portions of the yarn body between the dotted lines shown at 26 in FIG. 3. Consequently, only intermittent portions of the yarn length will have been treated with the liquid, and the length of these portions can readily be controlled by varying the axial length of applicator 22. The wetting of the intermittent portions of the yarn by the liquid reduces the re-wrinkling capability of the yarn and thereby changes the texture of the yarn where it is wetted to visibly contrast with the texture of the unwetted portions of the yarn. It will also be observed that the time during which the dewrinkling liquid is applied to the yarn body 20 is limited only by the length of time it takes the water to disappear through absorption and normal evaporation, and thus is independent of the speed of movement of the yarn through the operations shown in FIGS. 2 and 3.

Water is the preferred treating agent supplied to applicator 22.

In a specific example of practice of the invention, nylon polymer was spun into 144 filaments of 550 denier. The nylon was type 6 of Badische Corp. of Williamsburg, Va. The yarn was finished, bulked, treated, and wound as described above, using normal winding back tension (about 25 grams), and was used to make tufted fabric in a tufter having its needles 5/64 inch apart on centers, set to operate at 12 stitches per inch. The pile height was about ⅛", and the tufting was secured by a cured latex coating. In the course of curing the latex coating the tufting was heated and exposed to steam. The fibers were of the conventional trilobal cross-section, and the fabric showed the desired faint streaks of differently textured, less wrinkled, tufts randomly distributed across the face of the pile among the tufts of unmodified yarn which had not been water treated. This subdued variation has generated commercial interest demonstrating the practical utility of the practice of the invention.

While present preferred embodiments and practices of the invention have been illustrated and described, it will be understood that the invention is not limited thereto but may be otherwise embodied and practiced within the scope of the following claims.

We claim:

1. The process of treating a continuous multifilament bulked yarn which is capable of absorbing a fluid which causes its bulked texture to be modified to an extent visibly different from its bulked texture, comprising the steps of applying such fluid to intermittent lengths of the bulked yarn, permitting absorption of the applied fluid in the intermittent lengths while under tension sufficiently to alter their texture to a visibly contrasting extent, thereby causing the yarn to have lengths where it is bulked alternating with lengths of visibly different texture.

2. The process of claim 1, in which after said treatment the yarn is stitched into a backing fabric, cut into tufts, and heated and exposed to steam in the course of curing latex to secure the tufts in the backing fabric, whereby the pile of said tufts visibly shows a difference in texture between those tufts made from the treated lengths of the yarn as compared to those tufts made from the intermediate untreated lengths of the yarn.

3. The process of claim 2 repeated with multiple wound bodies of yarn to lay down closely adjacent rows of tufts of different strands of yarn made in the same way, whereby single intermittent rows of differently textured tufts are randomly distributed across the tufted face of the fabric among the otherwise visibly textured tufts made from the untreated portions of the yarns.

4. The process of claim 1, in which the fluid is a liquid when applied and in which the fluid applying step comprises winding the yarn under tension onto a wound body of the yarn, and applying said fluid to the yarn only where it is part of a minor portion of the wound body of yarn.

5. The process of claim 1 in which the fluid is a liquid when applied and in which the fluid applying step comprises winding the bulked yarn under tension onto a rotating wound body thereof and applying said fluid to a minor portion of the periphery of the yarn body as it rotates and winds.

6. The process of claim 5, in which the yarn is nylon and the fluid is water.

7. A wound body of continuous multifilament polymeric yarn, under tension, most of the body containing only the yarn in a form which is bulked when not under tension, and a minor portion of the body containing only the yarn in a form which when not under tension has a texture differing substantially from the bulked texture, said minor portion extending only around a minor length of the axis around which the body is wound, whereby yarn unwound from the body has lengths where it is in bulked form alternating with lengths of a visibly different texture.

8. The wound body of claim 7, in which the yarn is nylon.

9. Apparatus for producing multifilament yarn having alternating different textures along its length, comprising means to produce wrinkles in the filaments of the yarn, means to wind under tension the yarn previously so wrinkled onto a rotating wound body of the yarn, and means to apply a dewrinkling liquid to a minor part of the exposed surface of said rotating body as the exposed surface rotates.

10. Apparatus according to claim 9, in which the winding means comprises a grooved roll in rolling contact with the rotating body of yarn for guiding and traversing the yarn as it is wound onto the body, and the liquid applicator means comprises a porous member in contact with part of the surface of the grooved roll in rolling contact with the rotating body of yarn.

* * * * *